US006257876B1

(12) United States Patent
Chen

(10) Patent No.: US 6,257,876 B1
(45) Date of Patent: Jul. 10, 2001

(54) DISPOSABLE LIGHTER HOLDER

(76) Inventor: Hui Lin Chen, 971 Meridian Ave., Alhambra, CA (US) 91803

( * ) Notice: Subject to any disclaimer, the term of this patent is extended or adjusted under 35 U.S.C. 154(b) by 0 days.

(21) Appl. No.: 09/559,203

(22) Filed: Apr. 26, 2000

(51) Int. Cl.[7] ..... F23D 14/46

(52) U.S. Cl. ..... 431/345; 431/254; 431/274; 431/127

(58) Field of Search ..... 431/345, 153, 431/254, 273, 274, 277, 143, 275, 127; 126/401, 405, 406, 407

(56) References Cited

U.S. PATENT DOCUMENTS

| | | | | |
|---|---|---|---|---|
| 676,361 | * | 6/1901 | Glover | 431/345 |
| 4,222,734 | * | 9/1980 | Nolf | 431/277 |
| 4,259,059 | * | 3/1981 | Roosa et al. | 431/345 |
| 4,315,731 | * | 2/1982 | Moore | 431/345 |
| 4,389,187 | * | 6/1983 | Sims | 431/277 |
| 4,462,791 | * | 7/1984 | Hayden | 431/345 |
| 6,019,594 | * | 2/2000 | Denoia et al. | 431/153 |

* cited by examiner

*Primary Examiner*—Ira S. Lazarus
*Assistant Examiner*—Josiah C. Cocks
(74) *Attorney, Agent, or Firm*—Raymond Y. Chan; David and Raymond Patent Group

(57) ABSTRACT

A disposable lighter holder includes a holder frame providing a sliding chamber therein, a lighter holder for holding a disposable lighter in position slidably disposed in the sliding chamber, a resilient element connected between the holder frame and the lighter holder to normally urge and retain the lighter holder in a lower position, and an ignition member being arranged in such a manner that when a pushing force is applied by an adult's thumb on the pusher member in order to drive the lighter holder sliding frontwardly along the sliding chamber, simultaneously, a gas lever of the disposable lighter is depressed by the ignition member for releasing gas and a striker wheel of the disposable lighter is struck by the ignition member to rotate for generating striking sparks to ignite the releasing gas.

24 Claims, 6 Drawing Sheets

DISPOSABLE LIGHTER HOLDER

BACKGROUND OF THE PRESENT INVENTION

1. Field of Invention

The present invention relates to a disposable lighter, and more particularly to a disposable lighter holder which replaceably holds a disposable lighter for functioning as a barbecue lighter.

2. Description of Related Arts

A conventional barbecue lighter comprises an elongated tube outwardly extended from a casing of the lighter wherein a gas ejection nozzle is extended toward to a front end of the elongated tube such that ejecting gas will be ignited by an ignition tip at the front end of the elongated tube. Since the ignited ejecting gas has a distance from the casing of the lighter, which is the length of the elongated tube, a user is safe and easier to ignite the charcoal or stove.

The conventional barbecue lighter is usually employed with a piezoelectric unit wherein a striking spark is generated from the ignition tip when the piezoelectric unit is being compressed. However, the user has to buy the bottle of compressed gas in order to refill the barbecue lighter everytime when the gas is used up. The bottle of compressed gas is relatively expensive and is dangerous when a young child can reach or misuse the bottle of compressed gas. Furthermore, when the piezoelectricity of the piezoelectric unit is used up, the user is not able to refill the piezoelectric unit in order to re-use the barbecue lighter. So, the user has to buy another new barbecue lighter which will waste his or her money.

SUMMARY OF THE PRESENT INVENTION

A main object of the present invention is to provide a disposable lighter holder adapted to employ with a disposable lighter to function as a barbecue lighter.

Another object of the present invention is to provide a disposable lighter holder wherein everytime when the gas of the lighter is used up, a user can simply replace the disposable lighter with a new one easily.

Another object of the present invention is to provide a disposable lighter holder employing with a safety lock device to prevent the lighter from being unintentionally or accidentally ignited by the user.

Another object of the present invention is to provide a disposable lighter holder wherein no residue of the flint of the disposable lighter will stick on an adult's thumb after the ignition.

Another object of the present invention is to provide a disposable lighter holder which is adapted to be installed to all kind of disposable lighter.

Another object of the present invention is to provide a disposable lighter holder, which does not require to alter the original structure of the disposable lighter in order to incorporating with the present invention.

Accordingly, in order to accomplish the above objects, the present invention provides a disposable lighter holder adapted to employed with a disposable lighter to function as a barbecue lighter, wherein the disposable lighter holder comprises:

a holder frame having a rear portion constructed to form a handle and a front portion providing a sliding chamber which has a front end portion provided with an ignition member;

a lighter holder for holding the disposable lighter in position, wherein the lighter holder is slidably disposed in the sliding chamber in such a manner that a striker wheel and a gas lever of the disposable lighter are positioned opposing to the ignition member; and a resilient element connected between the front portion of the holder frame and the lighter holder for retaining the lighter holder in a normal position that prevents the disposable lighter from ignited by the ignition member, wherein when the lighter holder is pushed to slide towards the ignition member until the striker wheel of the disposable lighter striking against the ignition member, the ignition member pushes down the gas lever to generate gas and drives the striker wheel to rotate to produce sparks to ignite the gas generated, wherein when the pushing of the lighter holder is released, the resilient element pulls the lighter holder to slide away from the ignition member and back to the normal position thereof.

DETAILED DESCRIPTION OF THE PREFERRED EMBODIMENT

Figure 1:
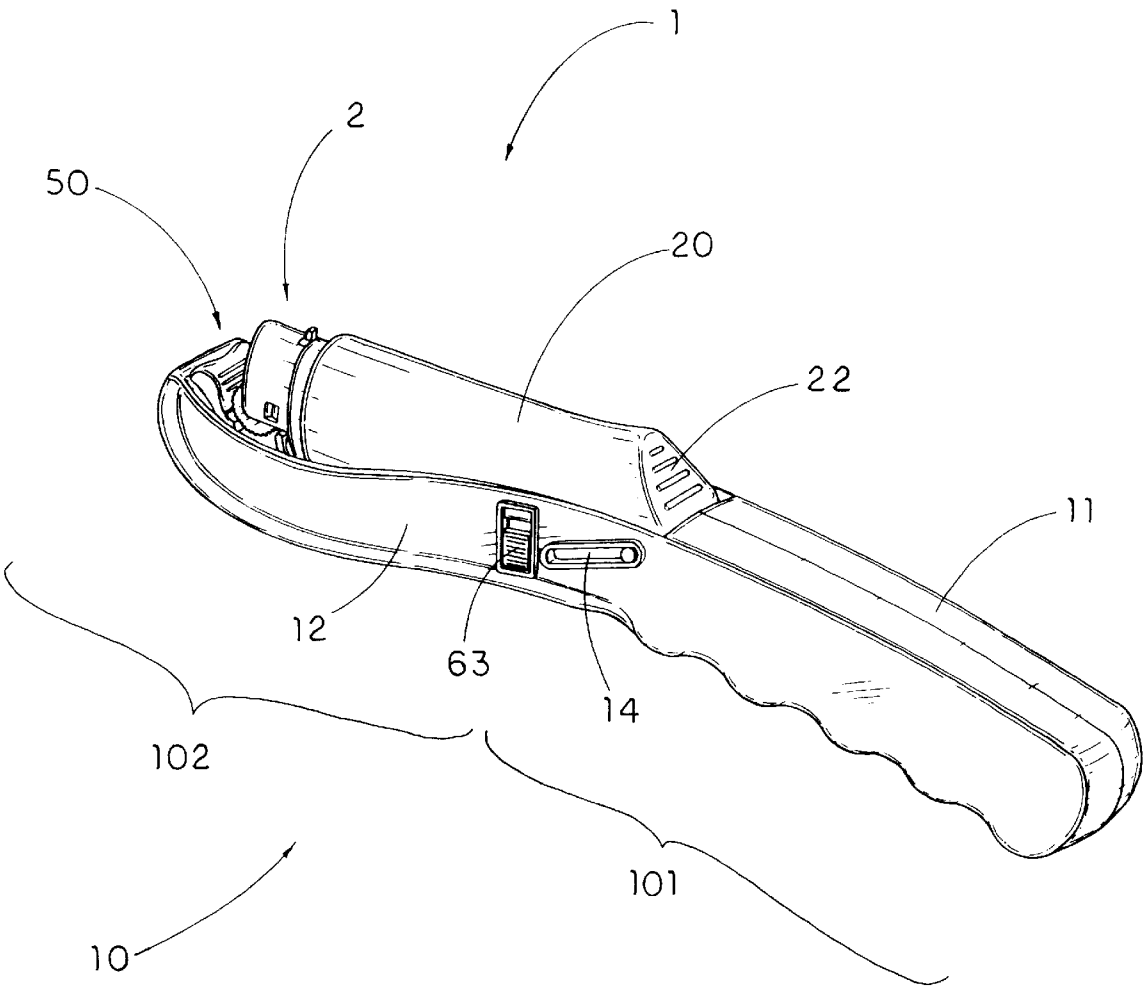
FIG. 1 is a perspective view of a disposable lighter holder according to a preferred embodiment of the present invention.
Figure 2:
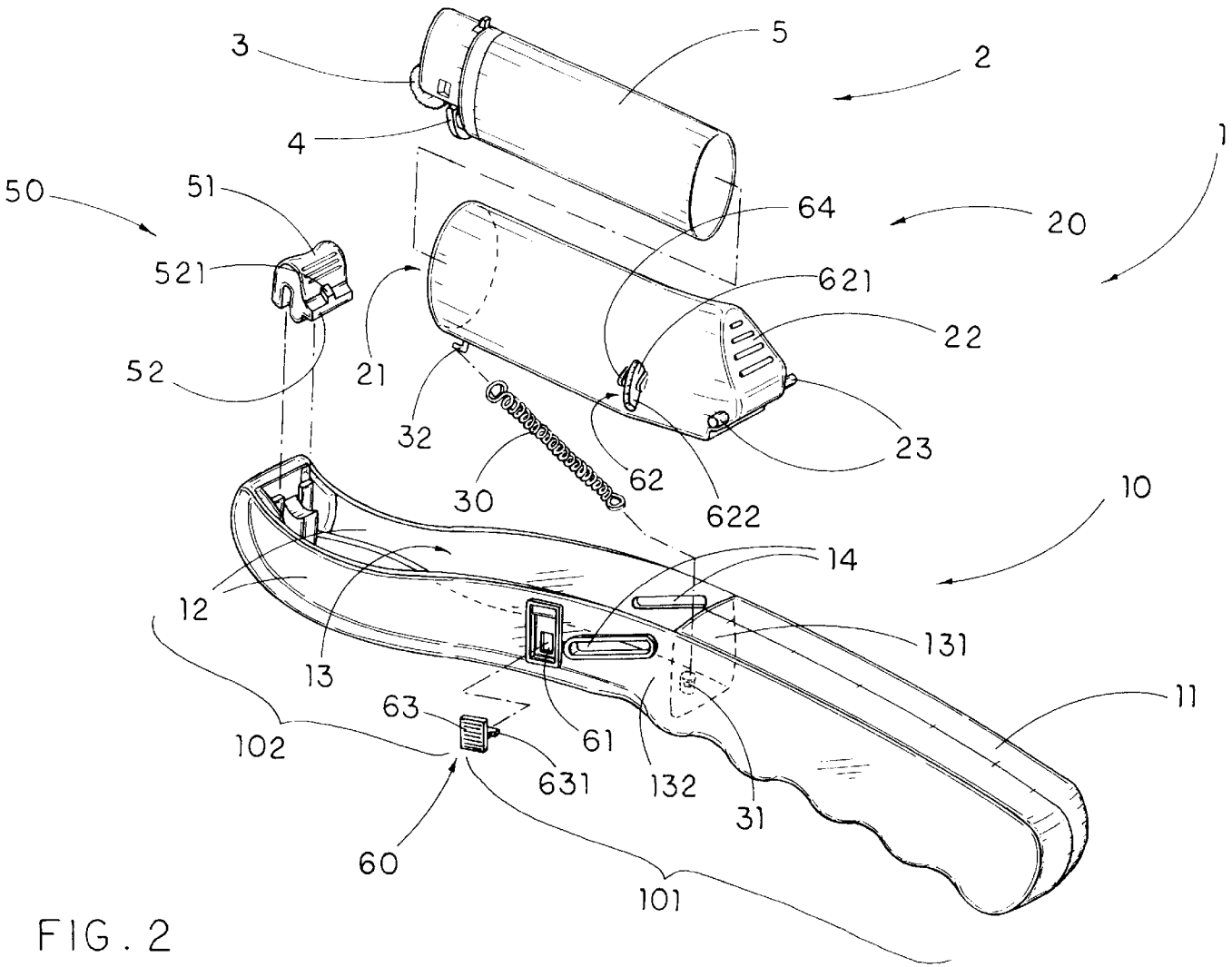
FIG. 2 is an exploded perspective view of the disposable lighter holder according to the above preferred embodiment of the present invention.

Referring to FIGS. 1 and 2 of the drawings, a disposable lighter holder 1 of the present invention is adapted to employed with the disposable lighter 2 to function as a barbecue lighter, wherein in order to ignite the disposable lighter 2, a striker wheel 3 must be intentionally rotated in order to generate striking sparks against a flint and simultaneously depress a gas lever 4 such that the ejecting gas is being ignited. The disposable lighter holder 1 comprises a holder frame 10, a lighter holder 20 and a resilient element 30.

The holder frame 10 has a rear portion 101 constructed to form a handle 11 and a front portion 102 providing a sliding chamber 13 which has a front end portion 121 provided with an ignition member 50.

The lighter holder 20 is adapted for holding the disposable lighter 2 in position, wherein the lighter holder 20 is slidably disposed in the sliding chamber 13 in such a manner that the striker wheel 3 and the gas lever 4 of the disposable lighter 2 are positioned opposing to the ignition member 50.

The resilient element 30 is connected between the front portion 102 of the holder frame 10 and the lighter holder 20 for retaining the lighter holder 20 in a normal position that prevents the disposable lighter 2 from ignited by the ignition member 50. Accordingly, when the lighter holder 20 is pushed to slide towards the ignition member 50 until the striker wheel 3 of the disposable lighter 2 striking against the ignition member 50, the ignition member 50 pushes down the gas lever 4 to generate gas and drives the striker wheel 3 to rotate to produce sparks to ignite the gas generated. Also, when the pushing of the lighter holder 20 is released, the resilient element 30 pulls the lighter holder 20 to slide away from the ignition member 50 and back to the normal position thereof.

Referring to FIGS. 1 to 6, the disposable lighter holder for holding the disposable lighter 2 according to a preferred embodiment of the present invention is further illustrated. The front portion 102 of the holder frame 10 has a pair of holding walls 12 upwardly extended from two sides thereof to construct a U-shaped cross section and define the sliding chamber 13 between the two holding walls 12. Two rear end portions of the two holding walls 12 respectively provide a pair of inclined guiding slots 14 which are frontwardly and downwardly extended symmetrically.

The lighter holder 20 has a tubular shape for holding the disposable lighter 2 in position and is slidably disposed in the sliding chamber 13 of the holder frame 10. The lighter holder 20 comprises a lighter cavity 21 adapted for fittingly receiving the disposable lighter 2 therein. In other words, a casing 5 of the disposable lighter 2 is adapted to be disposed in the lighter cavity 21 of the lighter holder 20 wherein the striker wheel 3 and the gas lever 4 of the disposable lighter 2 are exposed above a top of the lighter cavity 21.

The lighter holder 20 normally sits on a base wall 131 of the sliding chamber 13 wherein the base wall 131 of the sliding chamber 13 is biased against the lighter holder 20 at its bottom end such that the lighter holder 20 is adapted to be slid frontwardly along the sliding chamber 13.

The lighter holder 20 further comprises a pusher member 22 integrally provided at the rear end thereof, wherein the pusher member 22 has an enlarged surface exposed outside the sliding chamber 13.

The lighter holder 20 also comprises a pair of sliding pivots 23 integrally projected symmetrically from two sides of a rear end portion of the lighter holder 20 respectively. Therefore, the lighter holder 20 is pivotally connected to the front portion 102 of the holder frame 10 by slidably engaging the two sliding pivots 23 in the two guiding slots 14 respectively, wherein the pusher member 22 is arranged to be pushed to drive the lighter holder 20 sliding frontwardly along the sliding chamber 13 while the two sliding pivots 23 are guided to slide along the two guiding slots 14 respectively for guiding the longitudinal sliding movement of the lighter holder 20 within the sliding chamber 13.

The resilient element 30 connected between the holder frame 10 and the lighter holder 20 is used to normally urge and retain the lighter holder 20 in a rearward position wherein the bottom end of the lighter holder 20 sits on the base wall 131 of the sliding chamber 13 while the pusher member 22 remains exposed outside the sliding chamber 13.

According to the preferred embodiment of the present invention as shown in FIG. 2, the resilient element 30 is a compressive spring having two ends wherein one end thereof is connected to a rear portion of a bottom wall 132 of the sliding chamber 13 while another end is mounted on a front portion of the lighter holder 20 so as to apply a compressive pressure against the lighter holder 20 and to normally retain the lighter holder 20 in a normal position that prevents the disposable lighter 2 from ignited by the ignition member 50. According to the preferred embodiment, a first holding member 31 and a second holding member 32 are protruded from the bottom wall 132 of the sliding chamber 13 and the front portion of the lighter holder 20 for securely holding the two ends of the resilient element 30 so as to extend the resilient therebetween.

The ignition member 50 is securely mounted at the front end portion 121 of the holder frame 10 for igniting the disposable lighter 2 when the striker wheel 3 and the gas lever 4 are driven towards it. The ignition member 50 comprises a thumb-shaped striking head 51 outwardly extended from the holder frame 10 and a pushing tail 52 integrally and downwardly extended from the striking head 51 towards the sliding chamber 13. Moreover, the pushing tail 52 of the ignition member 50 has a tip 521 integrally and perpendicularly protruded from a middle of the pushing tail 52.

Figure 3:
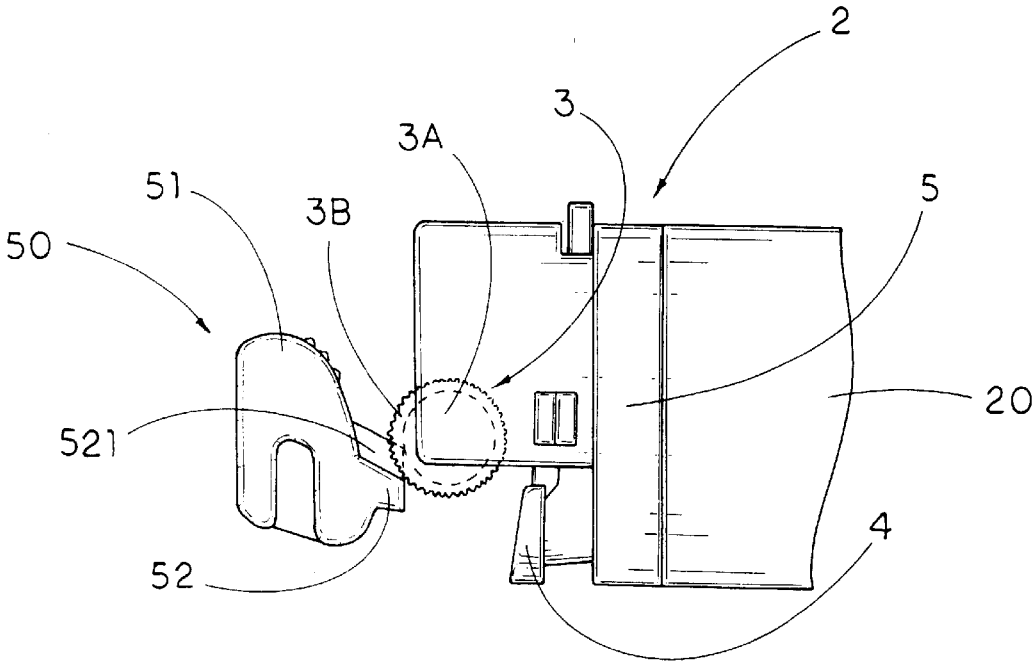
FIG. 3 is a partially side view of the disposable lighter holder according to the above preferred embodiment of the present invention, illustrating the ignition member and the disposable lighter in normal unignited position.
Figure 4:
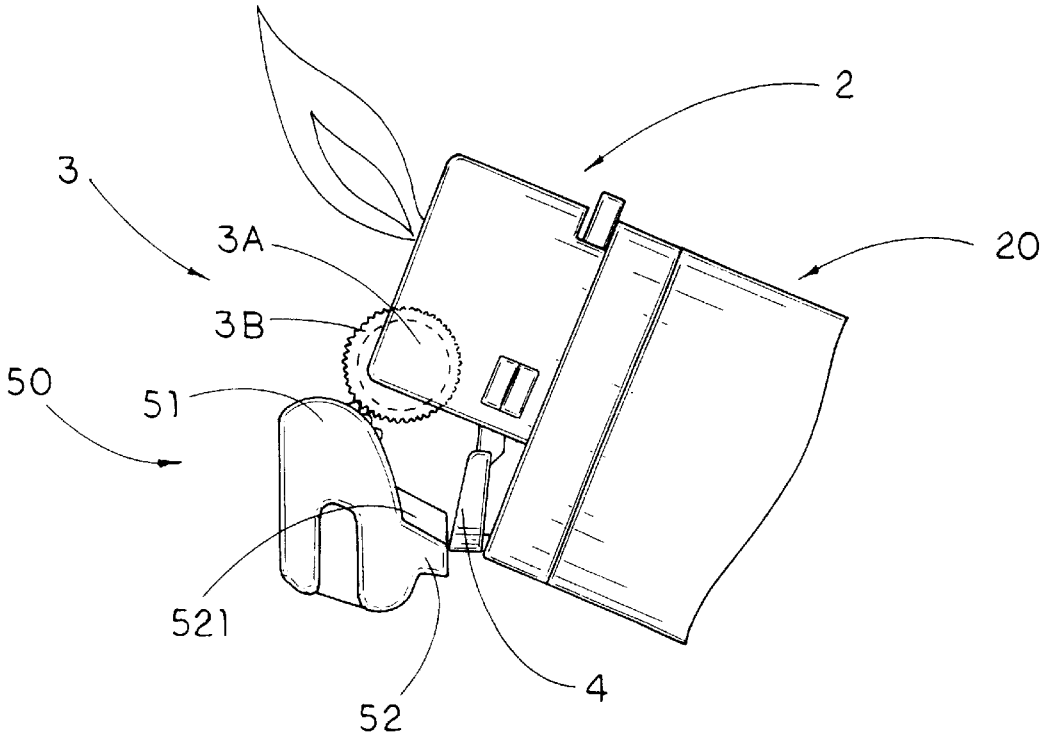
FIG. 4 is a partially side view of the disposable lighter holder according to the above preferred embodiment of the present invention, illustrating the ignition member and the disposable lighter in ignition position.

FIG. 3 illustrates the relationship of the striker wheel 3 and gas lever 4 of the disposable lighter 2 and the ignition member 50 of the disposable lighter holder 1 during the unignited normal position. In which, the striker wheel 3 of the disposable lighter 2 comprises a striking wheel 3*a* sandwiched between a pair of driving wheels 3*b* wherein the striking wheel 3*a* has a diameter smaller than the diameter of the driving wheel 3*b*. The driving wheels 3*b* are normally positioned on the pushing tail 52 of the ignition member 50 wherein the tip 521 of the pushing tail 52 is located between the two driving wheels 3*b* and in contact with the striking wheel 3*a* of the disposable lighter 2. So, when the disposable lighter 2 in the lighter holder 20 is frontwardly pushed in a longitudinally slidable manner, the striker wheel 3 is being rotated by the tip 521 and the gas lever 4 is depressed by a bottom of the pushing tail 52, as shown in FIG. 4. Preferably, the ignition member 50 has a rubber surface that can provide better friction to rotate the striker wheel 3 of the disposable lighter 2.

The disposable lighter holder 1 further comprises a safety means 60 comprising a first locking slot 61 provided on one of the holding walls 12 of the holder frame 10, a second locking slot 62 having a locking portion 621 and an unlocking portion 622 correspondingly provided on one side of the lighter holder 20, a locker button 63 having a locking latch 631 integrally extending therefrom slidably mounted on the first locking slot 61 and communicating with the second locking slot 62, and a pair of blocking walls 64 outwardly extended from the locking portion 621 of the second locking slot 62 for blocking the lighter holder 20 in a longitudinally movable manner.

The locking latch 64 of the locker button 62 is inserted through the first locking slot 61 to communicate with the second locking slot 62. The blocking walls 64 are integrally and opposedly extended from two sides of the second locking slot 62 at its locking portion 621. The locker button 62 is arranged to drive the locking latch 64 to slide between the locking portion 621 and the unlocking portion 622 in such a manner that when the locking latch 631 of the locker button 63 is slid to the locking portion 621 of the second locking slot 62, the locking latch 631 is blocked by the blocking walls 64 in longitudinal movement so as to block the lighter holder 20 in a longitudinally slidable manner. In other words, the lighter holder 20 is in unlocked position when the locker button 63 is slid on one side of the first locking slot 61 where the locking latch 631 is positioned in the unlocking portion 622 of the second locking slot 62. Likewise, the lighter holder 20 is in lock-up position when the locker button 63 is slid on another side of the first locking slot 61 where the locking latch 631 is positioned in the locking portion 622 of the second locking slot 62.

Figure 7:
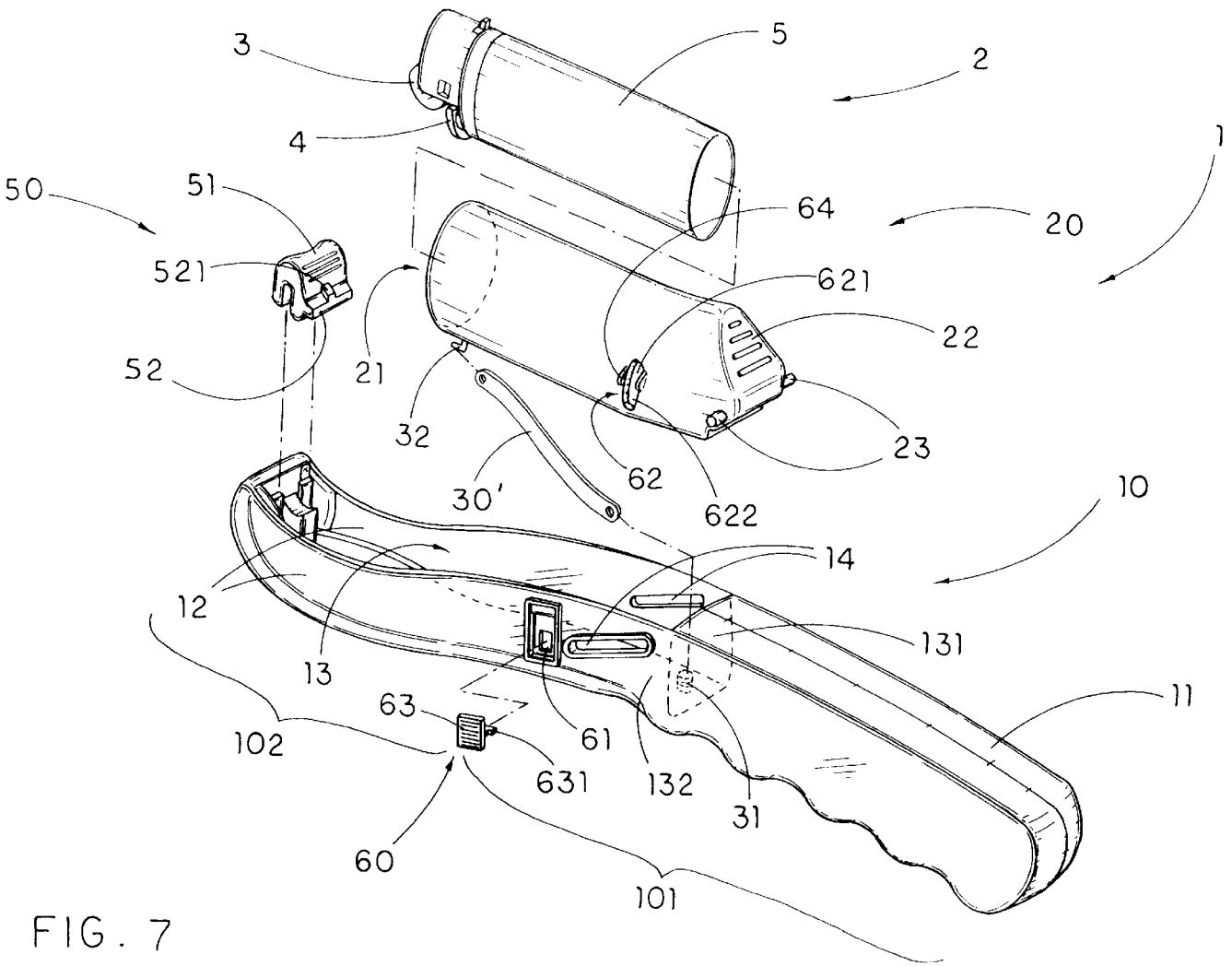
FIG. 7 is an exploded perspective view illustrating the disposable lighter holder having an alternative resilient element according to the above preferred embodiment of the present invention.

FIG. 7 illustrates an alternative mode of the resilient element 30' wherein an elastic strap is capable of substituting the compressive spring as shown in FIG. 2. The elastic strap 30' also has two ends connected to the first holding member 31 provided on the bottom wall 132 of the sliding chamber 13 and the second holding member 32 provided on the lighter holder 20 respectively for applying a compressive pressure to the lighter holder 20 to normally retain the lighter holder 20 in the normal position.

Figure 5:
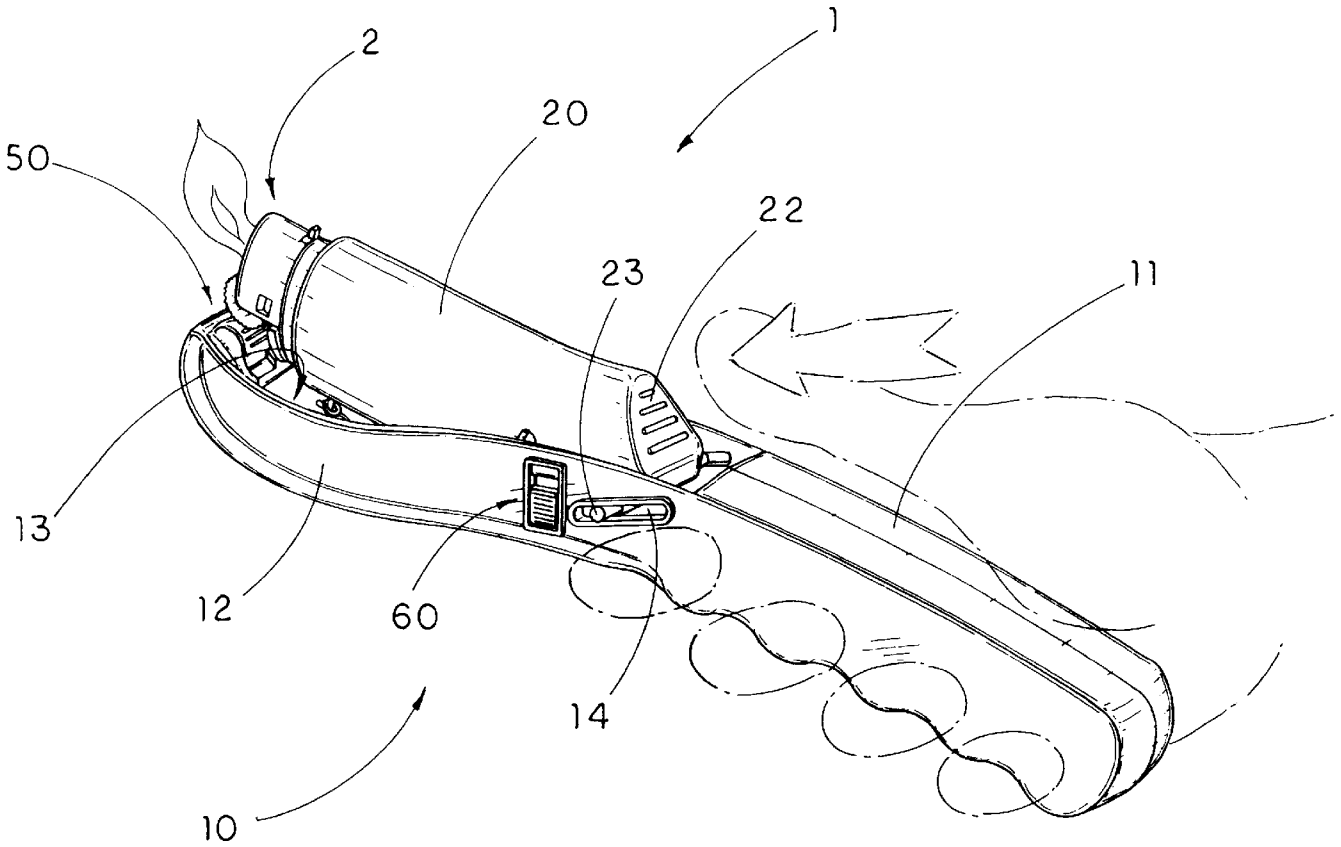
FIG. 5 is a perspective view of the disposable lighter holder according to the above preferred embodiment of the present invention, illustrating the disposable lighter being ignited.
Figure 6:
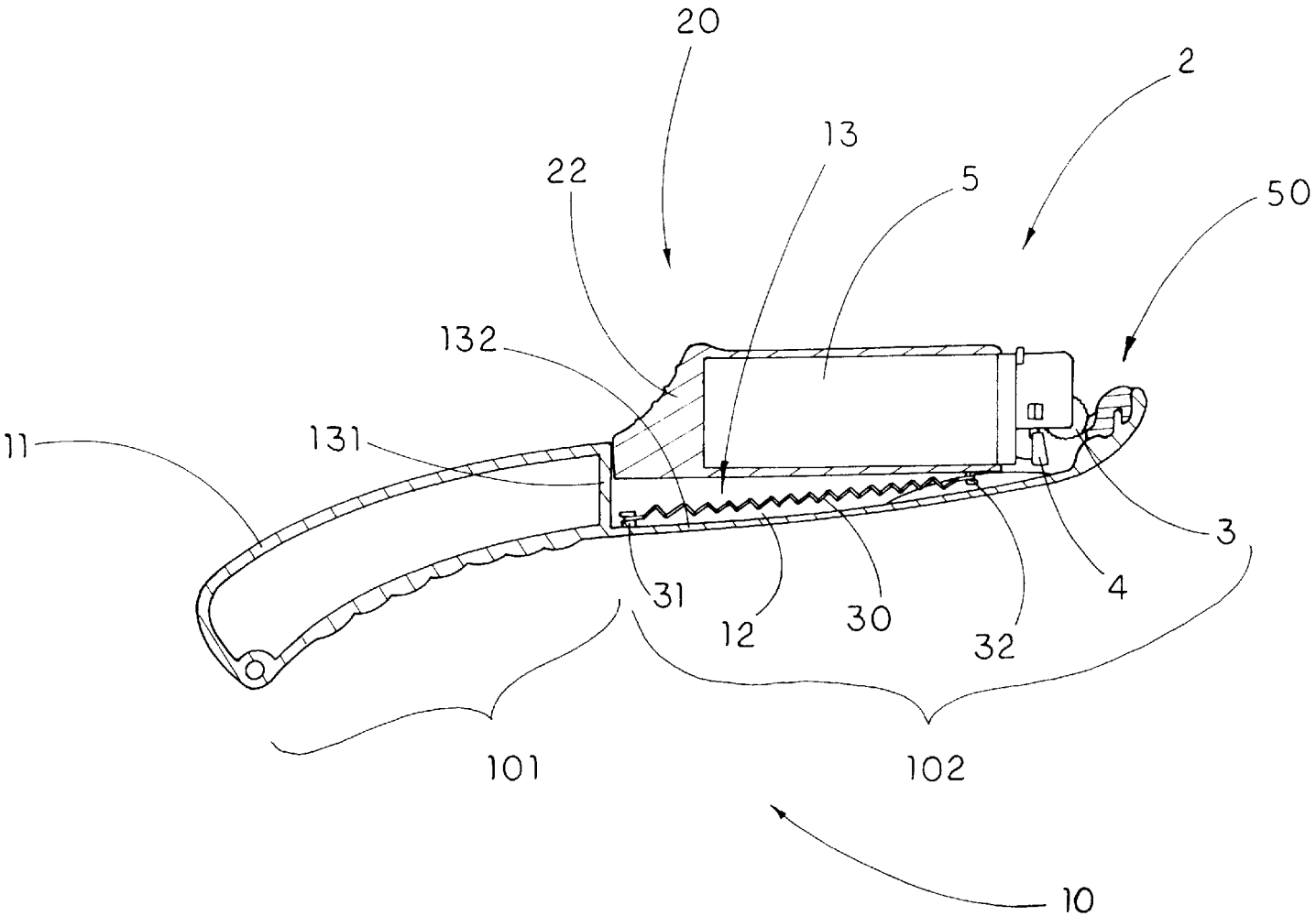
FIG. 6 is a sectional view of the disposable lighter holder employed with a disposable lighter according to the above preferred embodiment of the present invention.

Referring to FIGS. 5 and 6, in order to ignite the disposable lighter 2, a pushing force must be intentionally applied by an adult's thumb on the pusher member 22 in order to drive the lighter holder 20 sliding frontwardly along the sliding chamber 13. Simultaneously, the striker wheel 3 of the disposable lighter 2 is rotated by the tip 521 of the ignition member 50 for generating striking sparks and the gas lever 4 is being depressed for releasing gas. The disposable lighter 2 will be pulled at its lighting end out of the sliding chamber 13 of the holder frame 10 while the driving wheels 3*b* of the disposable lighter is slid along the protruded striking head 51 of the ignition member 50 so as to prevent the holder frame 10 from being burnt by the ignition of the disposable lighter 2, as shown in FIG. 4.

Once the pushing force applied on the pusher member 22 is released, the elongated resilient element 30 will automatically regain its original shape and pull the lighter holder 20 to return to its normal position. It is worth to mention that the guiding slots 14 and the corresponding sliding pivots 23 will guide the lighter holder 20 in a corrected slidably movable alignment with the holder frame 10 as well as the tip 521 of the ignition member 50 aligning with the striker wheel 3 of the disposable lighter 2.

In order to install the disposable lighter 2 into the disposable lighter holder 1 of the present invention, pivotally rotate up the lighter holder 20 about its sliding pivots 23 so as to upwardly position the opening of the lighter cavity 21 from the sliding chamber 13. Then, the old disposable lighter can simply be pull out of the lighter cavity 21 and reinserting a new disposable lighter 2 into the lighter cavity 21 of the lighter holder 20. Finally, the lighter holder 20 is pivotally rotated back to the sliding chamber 13 where the tip 521 of the ignition member 50 is engaged between the striking wheels 3*b* of the striker wheel 3 of the disposable lighter 2.

The advantages of the disposable lighter holder 1 of the present invention include the following:

1. The disposable lighter holder can be employed with a conventional disposable lighter to function as a barbecue lighter. In other words, the conventional disposable lighter can be modified to form a barbecue lighter by incorporating with the disposable lighter holder of the present invention, so that the adult's user is safe and easier to ignite the charcoal or stove with the disposable lighter.
2. The disposable lighter holder employed with the safety device can prevent any unwanted ignition of the lighter because when the locker button is switched to the locking position, the lighter holder cannot be pushed upwardly so as to prevent the lighter from being ignited accidentally.
3. The disposable lighter holder can prevent the lighter from being ignited by a young child under 5 years old. It is because the young child has insufficient power to pull the resilient element since the operation of the igniting the lighter requires enough power to push the lighter holder frontwardly.
4. When the disposable lighter inside the disposable lighter holder uses up its fuel, the user can replace a new disposable lighter to the present invention easily. In other words, the user has no need to buy bottles of fuel or piezoelectric unit for refilling the conventional barbecue lighter. Hence, the disposable lighter is relatively cheap and easy to buy so that the users do not need to pay more and find the refilling fuel, which is so inconvenient for the users.
5. Since the disposable lighter is ignited by the ignition member, the adult's thumb needs not to contact with the striker wheel. So, no residue of the flint of the disposable lighter will stick on the adult's thumb after the ignition.

What is claimed is:

1. A disposable lighter holder adapted to employed with a disposable lighter to function as a barbecue lighter, wherein said disposable lighter holder comprises:

a holder frame having a rear portion constructed to form a handle and a front portion providing a sliding chamber which has a front end portion provided with an ignition member, wherein said ignition member comprises a thumb-shaped striking head outwardly extended from said holder frame, a pushing tail integrally and downwardly extended from said striking head towards said sliding chamber, and a tip integrally and perpendicularly protruded from a middle of said pushing tail;

a lighter holder for holding said disposable lighter in position, wherein said lighter holder is slidably disposed in said sliding chamber in such a manner that a striker wheel and a gas lever of said disposable lighter are positioned opposing to said ignition member and said tip of said ignition member is located between two driving wheels of said striker wheel and kept in contact with a striking wheel positioned between said two driving wheels of said striker wheel; and a resilient element connected between said front portion of said holder frame and said lighter holder for retaining said lighter holder in a normal position that prevents said disposable lighter from ignited by said ignition member;

wherein when said lighter holder is pushed to slide towards said ignition member, said tip of said ignition member located between said two driving wheels of said striker wheel guides said striker wheel to move towards said thumb-shaped striking head until said striker wheel strikes against said thumb-shaped striking head of said ignition member, and, at the same time, said pushing tail of said ignition member depresses said gas lever down to generate gas and drives said striker wheel to rotate to produce sparks to ignite said gas generated, wherein when said pushing of said lighter holder is released, said resilient element pulls said lighter holder to slide away from said ignition member and back to said normal position thereof.

2. The disposable lighter holder, as recited in claim 1, wherein said front portion of said holder frame has a pair of holding walls upwardly extended from two sides thereof and define said sliding chamber between said two holding walls, and two rear end portions of said two holding walls respectively provide a pair of inclined guiding slots extended frontwardly and symmetrically, wherein said lighter holder comprises a pair of sliding pivots integrally projected symmetrically from two sides of a rear end portion of said lighter holder respectively, wherein said lighter holder is pivotally connected to said front portion of said holder frame by slidably engaging said two sliding pivots in said two guiding slots respectively.

3. The disposable lighter holder, as recited in claim 1, wherein said lighter holder has a tubular shape for holding said disposable lighter in position and is slidably disposed in said sliding chamber of said holder frame, said lighter holder comprising a lighter cavity adapted for fittingly receiving said disposable lighter therein while said striker wheel and said gas lever of said disposable lighter remain exposed out of said lighter cavity.

4. The disposable lighter holder, as recited in claim 2, wherein said lighter holder has a tubular shape for holding said disposable lighter in position and is slidably disposed in said sliding chamber of said holder frame, said lighter holder comprising a lighter cavity adapted for fittingly receiving said disposable lighter therein while said striker wheel and said gas lever of said disposable lighter remain exposed out of said lighter cavity.

5. The disposable lighter holder, as recited in claim 3, wherein said lighter holder normally sits on a base wall of said sliding chamber wherein said base wall of said sliding chamber is biased against said lighter holder at a bottom end thereof in such a manner that said lighter holder is capable of sliding frontwardly along said sliding chamber.

6. The disposable lighter holder, as recited in claim 4, wherein said lighter holder normally sits on a base wall of said sliding chamber wherein said base wall of said sliding chamber is biased against said lighter holder at a bottom end thereof in such a manner that said lighter holder is capable of sliding frontwardly along said sliding chamber.

7. The disposable lighter holder, as recited in claim 3, wherein said lighter holder further comprises a pusher member integrally provided at said rear end thereof, wherein said pusher member has an enlarged surface exposed outside said sliding chamber.

8. The disposable lighter holder, as recited in claim 4, wherein said lighter holder further comprises a pusher member integrally provided at said rear end thereof, wherein said pusher member has an enlarged surface exposed outside said sliding chamber.

9. The disposable lighter holder, as recited in claim 1, wherein said resilient element is a spring having two ends respectively connected to a rear portion of a bottom wall of said sliding chamber and said lighter holder.

10. The disposable lighter holder, as recited in claim 2, wherein said resilient element is a spring having two ends respectively connected to a rear portion of a bottom wall of said sliding chamber and said lighter holder.

11. The disposable lighter holder, as recited in claim 3, wherein said resilient element is a spring having two ends respectively connected to a rear portion of a bottom wall of said sliding chamber and said lighter holder.

12. The disposable lighter holder, as recited in claim 4, wherein said resilient element is a spring having two ends respectively connected to a rear portion of a bottom wall of said sliding chamber and said lighter holder.

13. The disposable lighter holder, as recited in claim 3, further comprises a safety means which comprises a first locking slot provided on one of said holding walls of said holder frame, a second locking slot having a locking portion and an unlocking portion correspondingly provided on one side of said lighter holder, a locker button having a locking latch integrally extending therefrom slidably mounted on said first locking slot and communicating with said second locking slot, and a pair of blocking walls outwardly extended from said locking portion of said second locking slot for blocking said lighter holder in a longitudinally movable manner.

14. The disposable lighter holder, as recited in claim 4, further comprises a safety means which comprises a first locking slot provided on one of said holding walls of said holder frame, a second locking slot having a locking portion and an unlocking portion correspondingly provided on one side of said lighter holder, a locker button having a locking latch integrally extending therefrom slidably mounted on said first locking slot and communicating with said second locking slot, and a pair of blocking walls outwardly extended from said locking portion of said second locking slot for blocking said lighter holder in a longitudinally movable manner.

15. The disposable lighter holder, as recited in claim 11, further comprises a safety means which comprises a first locking slot provided on one of said holding walls of said holder frame, a second locking slot having a locking portion and an unlocking portion correspondingly provided on one side of said lighter holder, a locker button having a locking latch integrally extending therefrom slidably mounted on said first locking slot and communicating with said second locking slot, and a pair of blocking walls outwardly extended from said locking portion of said second locking slot for blocking said lighter holder in a longitudinally movable manner.

16. The disposable lighter holder, as recited in claim 12, further comprises a safety means which comprises a first locking slot provided on one of said holding walls of said holder frame, a second locking slot having a locking portion and an unlocking portion correspondingly provided on one side of said lighter holder, a locker button having a locking latch integrally extending therefrom slidably mounted on said first locking slot and communicating with said second locking slot, and a pair of blocking walls outwardly extended from said locking portion of said second locking slot for blocking said lighter holder in a longitudinally movable manner.

17. A disposable lighter holder adapted to employed with a disposable lighter to function as a barbecue lighter, wherein said disposable lighter holder comprises:

a holder frame having a rear portion constructed to form a handle and a front portion providing a sliding chamber which has a front end portion provided with an ignition member, wherein said front portion of said holder frame has a pair of holding walls upwardly extended from two sides thereof and define said sliding chamber between said two holding walls, and two rear end portions of said two holding walls respectively provide a pair of inclined guiding slots extended frontwardly and symmetrically;

a lighter holder for holding said disposable lighter in position, wherein said lighter holder is slidably disposed in said sliding chamber in such a manner that a striker wheel and a gas lever of said disposable lighter are positioned opposing to said ignition member, wherein said lighter holder further comprises a pair of sliding pivots integrally projected symmetrically from two sides of a rear end portion of said lighter holder respectively, wherein said lighter holder is pivotally connected to said front portion of said holder frame by slidably engaging said two sliding pivots in said two guiding slots respectively; and a resilient element connected between said front portion of said holder frame and said lighter holder for retaining said lighter holder in a normal position that prevents said disposable lighter from ignited by said ignition member, wherein when said lighter holder is pushed to slide towards said ignition member until said striker wheel of said disposable lighter striking against said ignition member, said ignition member pushes down said gas lever to generate gas and drives said striker wheel to rotate to produce sparks to ignite said gas generated, wherein when said pushing of said lighter holder is released, said resilient element pulls said lighter holder to slide away from said ignition member and back to said normal position thereof.

18. The disposable lighter holder, as recited in claim 17, wherein said lighter holder has a tubular shape for holding said disposable lighter in position and is slidably disposed in said sliding chamber of said holder frame, said lighter holder comprising a lighter cavity adapted for fittingly receiving said disposable lighter therein while said striker wheel and said gas lever of said disposable lighter remain exposed out of said lighter cavity.

19. The disposable lighter holder, as recited in claim 18, wherein said lighter holder normally sits on a base wall of said sliding chamber wherein said base wall of said sliding chamber is biased against said lighter holder at a bottom end thereof in such a manner that said lighter holder is capable of sliding frontwardly along said sliding chamber.

20. The disposable lighter holder, as recited in claim 19, wherein said lighter holder further comprises a pusher member integrally provided at said rear end thereof, wherein said pusher member has an enlarged surface exposed outside said sliding chamber.

21. The disposable lighter holder, as recited in claim 19, wherein said resilient element is a spring having two ends respectively connected to a rear portion of a bottom wall of said sliding chamber and said lighter holder.

22. The disposable lighter holder, as recited in claim 20, wherein said resilient element is a spring having two ends respectively connected to a rear portion of a bottom wall of said sliding chamber and said lighter holder.

23. The disposable lighter holder, as recited in claim 19, further comprises a safety means which comprises a first locking slot provided on one of said holding walls of said holder frame, a second locking slot having a locking portion and an unlocking portion correspondingly provided on one side of said lighter holder, a locker button having a locking latch integrally extending therefrom slidably mounted on said first locking slot and communicating with said second locking slot, and a pair of blocking walls outwardly extended from said locking portion of said second locking slot for blocking said lighter holder in a longitudinally movable manner.

24. The disposable lighter holder, as recited in claim 22, further comprises a safety means which comprises a first locking slot provided on one of said holding walls of said holder frame, a second locking slot having a locking portion and an unlocking portion correspondingly provided on one side of said lighter holder, a locker button having a locking latch integrally extending therefrom slidably mounted on said first locking slot and communicating with said second locking slot, and a pair of blocking walls outwardly extended from said locking portion of said second locking slot for blocking said lighter holder in a longitudinally movable manner.

* * * * *